US005377971A

United States Patent [19]

Ganter

[11] Patent Number: 5,377,971

[45] Date of Patent: Jan. 3, 1995

[54] AIR-FLOW GENERATING DEVICE FOR A SHEET DELIVERY OF A SHEET-FED PRINTING MACHINE

[75] Inventor: Udo Ganter, Hirschberg-Leutershausen, Germany

[73] Assignee: Heidelberger Druckmaschinen AG, Heidelberg, Germany

[21] Appl. No.: 50,709

[22] Filed: Apr. 21, 1993

[30] Foreign Application Priority Data

Apr. 21, 1992 [DE] Germany ..... 4213020

[51] Int. Cl.[6] ..... B65H 31/00

[52] U.S. Cl. ..... 271/207; 271/184

[58] Field of Search ..... 271/177, 184, 195, 207, 271/211, 213–215, 217

[56] References Cited

U.S. PATENT DOCUMENTS

| | | | |
|---|---|---|---|
| 2,769,495 | 11/1956 | Pomper et al. | 271/195 X |
| 3,880,297 | 4/1975 | Martin . | |
| 3,971,554 | 7/1976 | Stange . | |
| 4,062,536 | 12/1977 | Michelson . | |
| 4,405,125 | 9/1983 | Kulpa et al. | 271/195 |
| 4,526,648 | 7/1985 | Tochtermann | 271/195 X |
| 4,625,956 | 12/1986 | Marass et al. | 271/195 X |
| 5,060,928 | 10/1991 | Vits . | |

FOREIGN PATENT DOCUMENTS

| | | |
|---|---|---|
| 649326 | 8/1937 | Germany . |
| 1252139 | 10/1967 | Germany . |
| 1282556 | 11/1968 | Germany . |
| 1511266 | 7/1969 | Germany . |
| 1906090 | 8/1970 | Germany . |
| 2944227 | 5/1980 | Germany . |
| 3413179 | 10/1985 | Germany . |
| 3920407 | 8/1990 | Germany . |
| 990470 | 4/1965 | United Kingdom . |
| 1247549 | 9/1971 | United Kingdom . |
| 2037259 | 7/1980 | United Kingdom . |

*Primary Examiner*—David H. Bollinger

*Attorney, Agent, or Firm*—Herbert L. Lerner; Laurence A. Greenberg

[57] ABSTRACT

Sheet delivery for a sheet-processing machine having a sheet-conveying device for successively conveying sheets to a device for receiving a sheet pile thereon, includes a device disposed above the sheet-pile receiving device for generating an air flow to facilitate with air a depositing of the sheets upon the pile-receiving device, the air-flow generating device having an air-supplied air-volume chamber having a basal surface and formed with outlet openings distributed over the basal surface thereof, the basal surface having an area corresponding approximately to a maximum sheet format.

12 Claims, 3 Drawing Sheets

AIR-FLOW GENERATING DEVICE FOR A SHEET DELIVERY OF A SHEET-FED PRINTING MACHINE

The invention relates to a sheet delivery for a sheet-processing machine, more particularly, a sheet-fed printing machine having a sheet-conveying device for conveying sheets successively to a device for receiving a pile of the sheets, an air-flow generating device being disposed above the sheet pile-receiving device for facilitating with air sheet-deposition onto the pile.

Sheet deliveries of conventional sheet-fed printing machines, respectively, have a delivery gripper system guiding the printed sheets to a sheet pile (delivery pile). In order to achieve the formation of a precise pile, it has become known heretofore to use an air-generating device which is disposed above a device for receiving the sheet pile (a delivery table, paper stops, and so forth), by which the sheets, released by the grippers of the delivery gripper system and delayed by means of a sheet braking device, are subjected to air for the purpose of increasing the velocity of the descent of the sheets which are being deposited.

Such an air-flow generating device is disclosed in German Published Non-Prosecuted Patent Application (DE-OS) 34 13 179 as having several blowers which are distributed over a maximally possible sheet format area and which are activated in accordance with the demand. The rotary speeds of the individual blowers or fans may be adjusted in accordance with the intensity of the respective desired air flow. Moreover, it is has become known heretofore from the aforementioned German patent application to provide, in addition to the blowers, air blast or blowing-air pipes or tubes which, in combination, form air blast or blowing-air rakes having, over the lengths thereof, small bores formed therein through which, respectively, a targeted air flow escapes.

The air-flow generating device heretofore known from the German patent application fails to meet adequately the different requirements dependent upon paper thickness, ink application, subject or motif formation, printing format, and so forth; in particular, at high printing speeds, the limits of such systems are readily revealed.

It is accordingly an object of the invention to provide a sheet delivery of the aforementioned general type with an air-flow generating device which ensures an optimum and very rapid sheet delivery under all operating conditions. More-over, a particularly simple construction for the device is sought after.

With the foregoing and other objects in view, there is provided in accordance with the invention, a sheet delivery for a sheet-processing machine having a sheet-conveying device for successively conveying sheets to a device for receiving a sheet pile thereon, comprising a device disposed above the sheet-pile receiving device for generating an air flow to facilitate with air a depositing of the sheets upon the pile-receiving device, the air-flow generating device having an air-supplied air-volume chamber having a basal surface and formed with outlet openings distributed over the basal surface thereof, the basal surface having an area corresponding approximately to a maximum sheet format.

In contrast with the state of the art, no individual blowers and additional blowing-air rakes are provided in the sheet delivery according to the invention; but rather, the maximum sheet-format range, which depends, in each case, upon the type of sheet-fed printing machine, is covered by the basal surface of the air-volume chamber, with outlet openings distributed over the basal surface ensuring that the respective sheet is subjected to a selective air flow. The plurality of partial air flows which escape through the individual outlet openings and act upon a respective sheet ensure that the sheet descends or is lowered at high depositing speed and that the position at which it is deposited or delivered is precise and reproducible. This results in precise pile formation, even at very high printing speeds.

The inventive air-volume chamber represents a material construction simplification in comparison with the conventional complex state-of-the-art arrangement of blowers, with air-blast or blowing-air pipes disposed between the blowers. The air-volume chamber may be supplied with air by the air-pressure device which is always available in sheet-fed printing machines, or by a separate central compressor or blower unit. Because the basal surface of the air-volume chamber corresponds approximately to the maximally possible sheet format of the respective sheet-fed printing machine, it is possible always to deposit or deliver sheets of any sheet format, even maximum sheet sizes, exactly and rapidly.

In accordance with another feature of the invention, covering means are included for sealing at least some of the outlet openings so as to adjust air-flow intensity and/or air diffusion of air escaping from the air-volume chamber. The covering means permits the respective sheet to be concretely blown-on independently of the sheet format and/or the motif or subject thereof, and so forth. Wavy regions of the sinking or descending sheets, for example, are able to be blown-on by partial air flows escaping through respective outlet openings, so that a sheet deposit or delivery in a stable position, for example, in a V position, is possible. Due to the covering means, it is possible, among other things, to adapt the air-escape range to the individual sheet sizes, which ensures a more accurate control and, moreover, lowers air consumption and the energy cost thereof. Adjusting to the respective print-job sheets takes only very little time and is not complicated, because only those outlet openings which are not needed to generate the air flow for sheet depositing or delivery have to be closed by the covering means.

In accordance with a further feature of the invention, the air-volume chamber has a bottom wall formed with a basal surface, the outlet openings being formed in the bottom wall.

In accordance with an added feature of the invention, the bottom wall is a perforated plate. In accordance with an alternate feature of the invention, the bottom wall is a plate formed with a multiplicity of round holes therein. The round-hole plate may correspond, for example, to German Industrial Norm (DIN) 24 041. The round-hole plate may be covered by an appropriate surface material; partial regions of the maximum sheet format corresponding to the basal surface may, for example, be sealed by covering plates or foils. The covering plates or foils may be laid on supporting grids or the like which are disposed at a given spaced distance from the bottom wall of the air-volume chamber so that the covering means may be received thereat. It is also conceivable to use adhesive foils which are stuck onto the basal surface wherein the outlet openings are formed, thereby sealing the respective outlet openings.

In accordance with an additional feature of the invention, the bottom wall is formed, at least in part, of ferromagnetic material.

In accordance with yet all other feature of the invention, the covering means are a magnetic covering.

In accordance with alternate features of the invention, the magnetic covering is formed of at least one magnetic plate and/or at least one magnetic foil.

The form and size of the magnetic plate or foil meet the respective requirements, and the magnetic plate or foil is provided so as to magnetically adhere tightly to the ferromagnetic bottom wall in an appropriate position for the purpose of sealing certain outlet openings. In particular, plastic or synthetic magnetic foils may be used for sealing purposes; with the aid of a pair of scissors, the pressman may cut the foils as required and can suitably place them so that they adhere to the bottom wall of the air-volume chamber for controlling air diffusion or distribution.

In accordance with yet an added feature of the invention, the covering means are formed of a plurality of individual covers.

In accordance with yet an added feature of the invention, the air-volume chamber is formed with a plurality of sectional or sub-chambers. This permits air to be zonally blown onto the sheet, so that the sectional chambers may be individually subjected to air. For relatively small sheet formats, it is possible, for example, not to supply the marginal sectional chambers with air so that the area onto which air is blown corresponds to the sheet-format area. It is also conceivable to subject the sectional chambers to varying air-flow intensities in order to blow air more-or-less intensely onto selective areas of the sheets to be delivered.

In accordance with yet an additional feature of the invention, partitions are disposed in the air-volume chamber and define the sectional chambers.

In accordance with another feature of the invention, separate air-intake connections, respectively, communicate with each of the sectional chambers.

In accordance with a concomitant feature of the invention, an air-intake control device is connected to the air-intake connections for supplying an individually determinable air flow therethrough to each of the sectional chambers. Each of the air-intake connections is individually controllable.

Other features which are considered as characteristic for the invention are set forth in the appended claims.

Although the invention is illustrated and described herein as embodied in an air-flow generating device for a sheet delivery of a sheet-fed printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
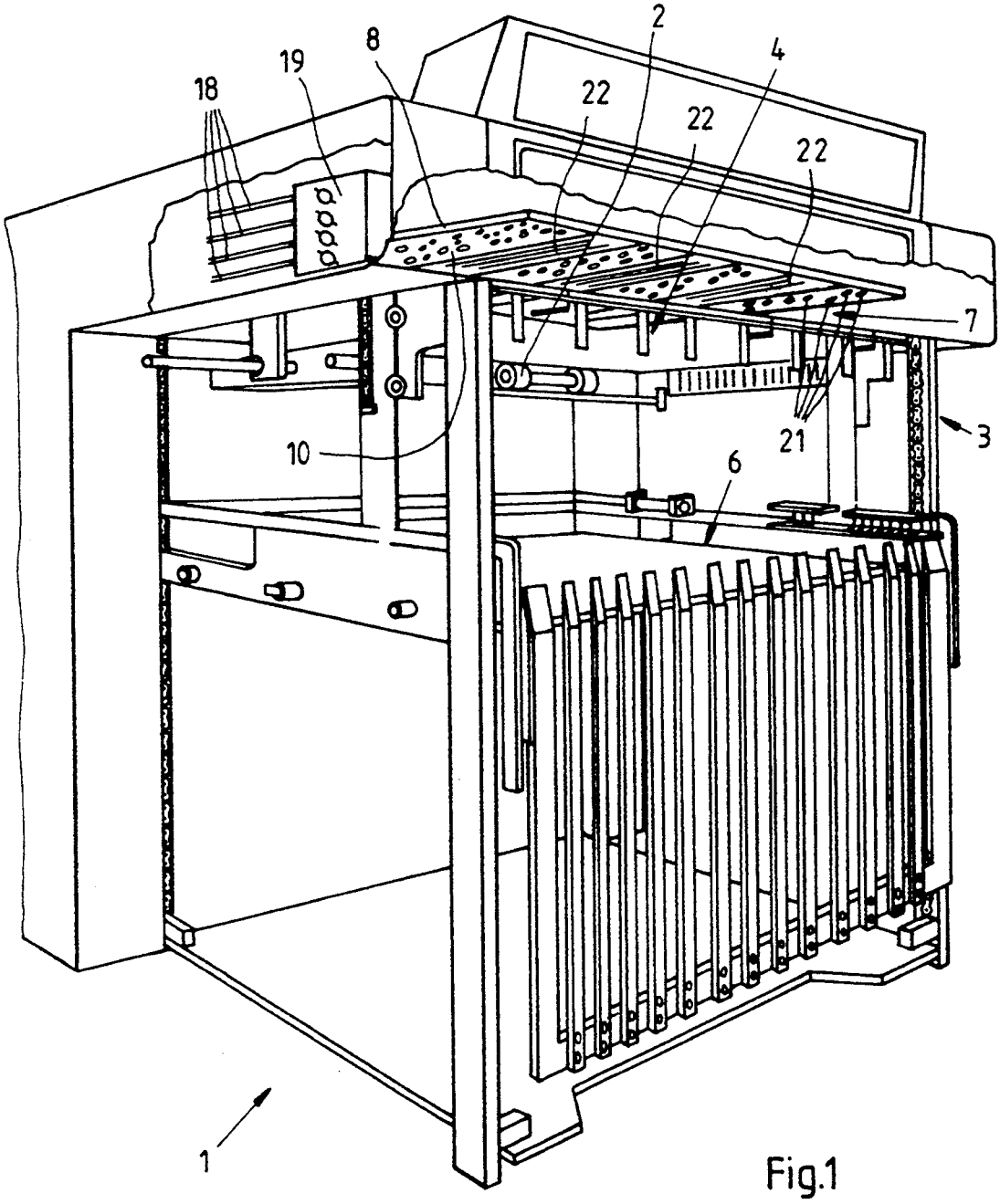
FIG. 1 is a perspective view of a sheet delivery of a sheet-fed printing machine incorporating therein an air-flow generating device according to the invention.

Referring now to the drawings and, first, particularly to FIG. 1 thereof, there is shown therein a sheet delivery 1 of a sheet-fed printing machine having a non-illustrated sheet-conveying device preferably constructed as a delivery gripper system for conveying printed sheets coming from a non-illustrated printing unit at high speed. Grippers of the delivery gripper system open to release the printed sheets, the velocity of the printed sheets being braked by a suction roller or sheet braking device 2, and the sheets being deposited on a device 3 for receiving a sheet pile to be formed in this manner. The device 3 is formed with a stop 4 for respective leading edges of the sheets, stops 5 (FIG. 2) for respective lateral edges of the sheets, and a deposit or delivery table 6 which is lowered in accordance with the height of the sheet pile being formed. Above the device 3 is an air-flow generating device 7 which serves to effect a targeted or selective sheet deposit or delivery onto the sheet pile. A vertical air flow or current emerges from the air-flow generating device 7 and, inter alia, increases the velocity of descent of the respective sheet, thus exerts an influence upon the sheet depositing or delivery behavior.

Figure 2:
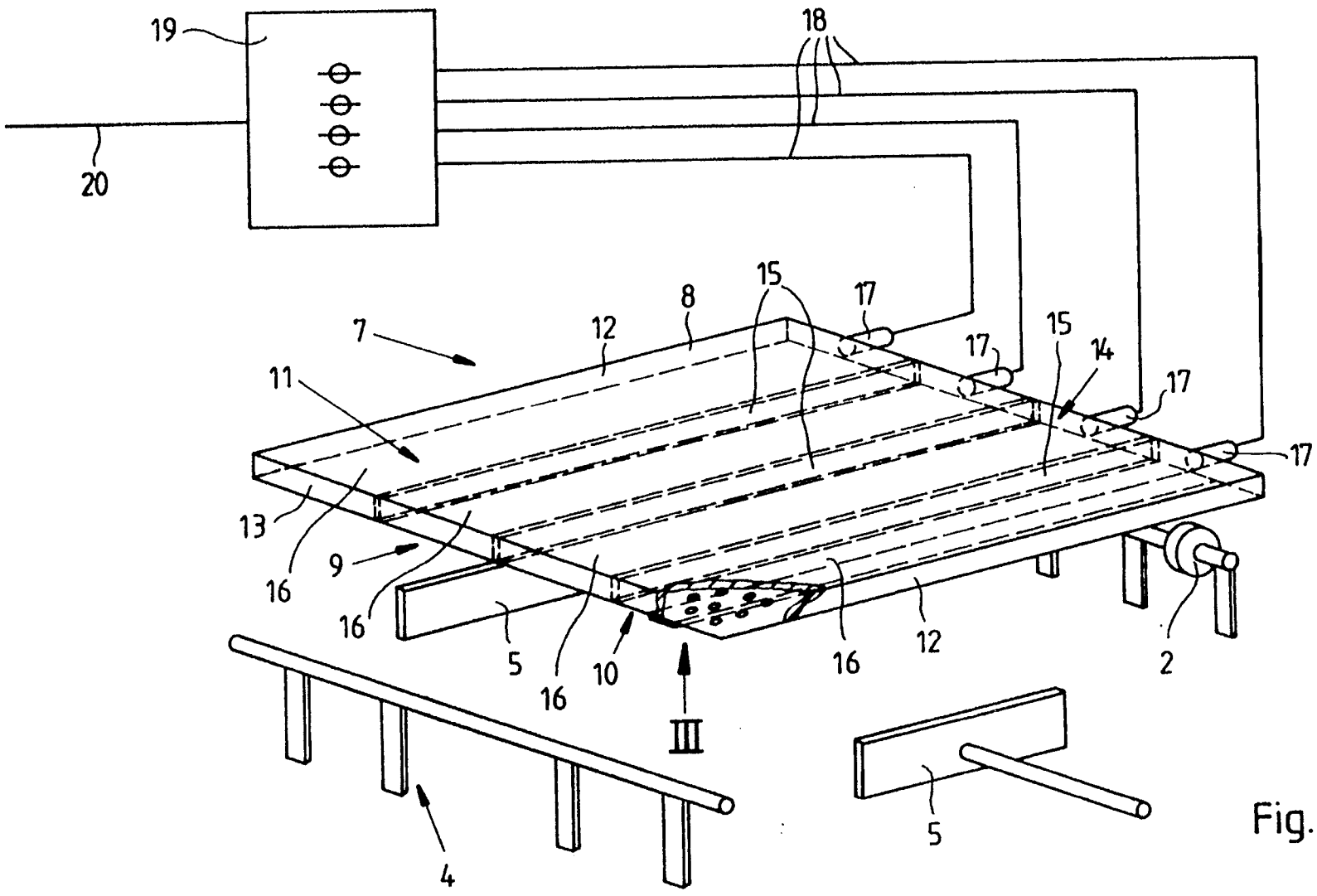
FIG. 2 is a diagrammatic perspective and partly schematic view of the air-flow generating device and a device for receiving a sheet pile.

In particular, FIG. 2 shows a constructional realization or embodiment of the air-flow generating device 7 as an air volume chamber 8 having the shape of a cuboidal or parallelepipedal hollow body with a bottom wall 10 having a basal surface 9, a ceiling or top wall 11, side walls 12, a front end wall 13 and a rear end wall 14. The area of the basal surface 9 of the air-volume chamber 8 corresponds approximately to the maximally possible sheet format which can be produced on the sheet-fed printing machine.

Three partitions 15 extending parallel to the side walls 12 are disposed within the air-volume chamber 8 and divide the inner volume of the air-volume chamber 8 into four, preferably equal, sectional or sub-chambers 16. Four air-intake connections or unions 17 are provided in the rear end wall 14, each thereof leading into a respective sectional chamber 16 and being connected to an air-intake control device 19 via a pipe or hose connection 18. A main air-intake line 20 supplies the air-intake control device 19. The main air-in-take line 20 is connected to a non-illustrated compressed-air source or a compressor.

Figure 3:
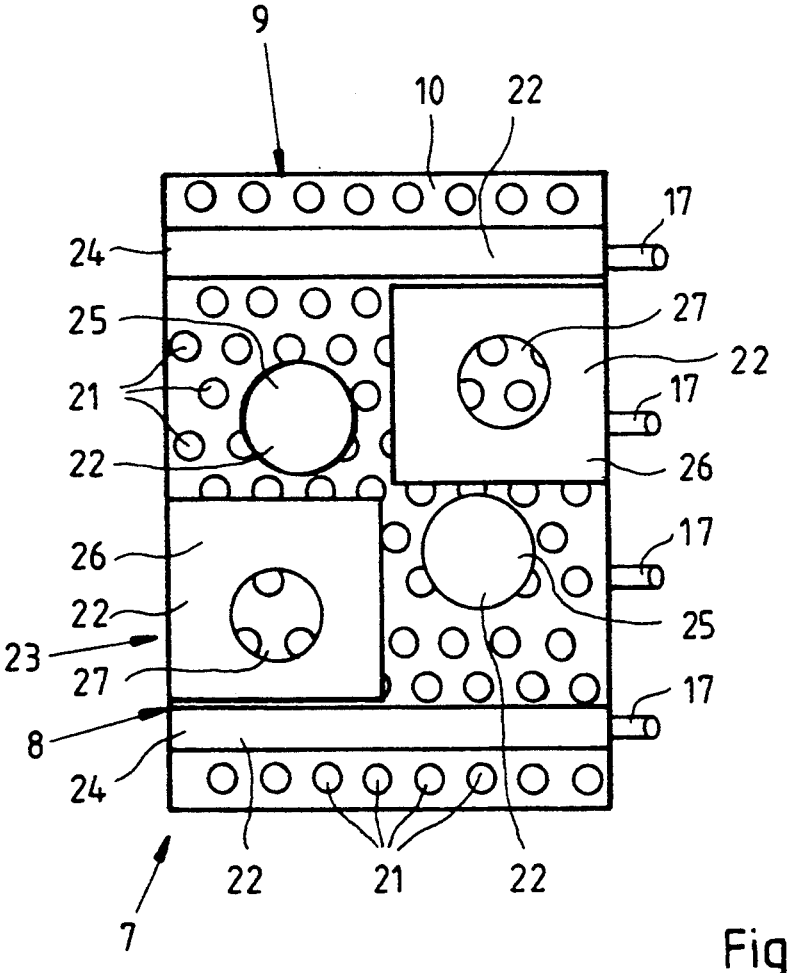
FIG. 3 is an enlarged fragmentary view of the air-flow generating device of FIG. 2 taken in the direction of the arrow III.

As is apparent from FIG. 3, which is a fragmentary view of FIG. 2 in the direction of the arrow III towards the air volume chamber 8, the bottom wall 10 is penetrated by outlet openings 21 which are uniformly distributed over the entire basal surface 9 of the air-volume chamber 8. The bottom wall 10 is preferably formed of a ferromagnetic round-hole plate, particularly of the type which meets the requirements of German Industrial Norms (DIN) 24 041. Magnetic foils 22 of varying planar form are arranged on the bottom wall 10 so as to adhere magnetically thereto, the magnetic foils 22, in accordance with the shape and position thereof, covering or sealing the respective outlet openings 21 which are involved. In this respect, the magnetic foils 22 form a covering 23 by means of which air-flow intensity and air diffusion of the air flow or current escaping from the perforated bottom wall 10 of the air-volume chamber 8 can be adjusted as desired.

The sheet delivery according to the invention operates in the following manner: The velocity at which the printed sheets are conveyed, approximately horizontally, to the vicinity of the device 3 for receiving the sheet pile is slowed down or braked by the suction roller 2, and the sheets abut the sheet leading-edge stop 4. Moreover, the sheets are guided through the space between the lateral paper stops 5. They are seized simultaneously by the air flow formed by the air-flow generating device 7 and accelerated thereby, as well as delivered precisely aligned and in a guided manner onto the delivery or deposit table 6 already having a sheet pile formed thereon. By means of the covering 23 formed of one or more suitably arranged and shaped magnetic foils 22 magnetically adhering to the bottom wall 10 of the air-volume chamber 8, a selected number of the outlet openings 21 are covered or sealed so that not even any partial air flows are able to escape therethrough. The result thereof is that the sheets to be deposited or delivered are subjected to an air-flow intensity and air diffusion which has been adjusted by the covering 23, these air parameters having thus been adjusted very gradually and selectively over the entire basal surface 9 due to the large number of outlets 21 and the many possible ways of covering them. By appropriately arranging the magnetic foils 22, the printing format, the motif or subject formation, the ink/dampening medium distribution and, if necessary, the resulting waviness of the sheet to be delivered, for example, may be taken into account.

By means of the strips 24 of the magnetic foils 22 disposed close to the edge of the bottom wall 10, for example, as shown in FIG. 3, it is thus conceivable to construct conventional air blast or blowing-air tubes or pipes by leaving only the marginal outlets 21 free as rows of holes. Moreover, it is also conceivable to achieve a quite special air diffusion by constructing the magnetic foils 22, as shown in FIG. 3, in the form of squares and rectangles 26, respectively, having cut-outs or apertures 27 provided therein, or in the form of circles 25, so that the sheets subjected to the air flow may be individually blown on by the blowing air therefrom.

If a change in a printing job should occur, the pressman may possibly have to alter the covering 23 by, for example, taking into account a changed sheet format and/or a different motif or subject and/or a different type of printing material or paper with respect to the agreed or complete printing job. For standard printing jobs, the pressman may prepare in advance or make-ready coverings 23 which he can readily exchange for a previously used covering 23. The magnetic foils 22 may also be provided without problem on the bottom wall 10 of the air-volume chamber 8 so that regions thereof overlap.

The sheet delivery constructed in accordance with the invention may, in a very simple and rapid, finely controllable manner, be adapted to the varying delivery or depositing behavior of different printing products. It is not difficult to achieve a swift and reliable, reproducible sheet deposit or delivery, even at extremely high printing speeds.

Because the air-volume chamber 8, as shown in FIG. 2, is divided into several sectional or sub-chambers 16, a zonal control of the air-intake feed is possible. This is effected by the air-intake control device 19 which, in accordance with another embodiment of the invention, may also be constructed as a control valve. By means of the air-intake control device 19, the main air flow supplied by a suitable non-illustrated production device via the main air-intake line 20 is split individually and fed to the individual sectional or sub-chambers 16 via the pipe and hose connections 18, respectively, and via the air-intake connections or unions 17. Thus, it is possible, for example, to supply a sectional or sub-chamber 16 with more or less air flow. Moreover, it is possible to block a respective pipe and hose connection 18 completely so that no air flow may escape from the respective sectional or sub-chamber 16.

It is possible, of course, to provide a greater number of sectional or sub-chambers 16, in comparison with those of the embodiment of the invention shown in FIG. 2, or to partition the sectional or sub-chambers 16 differently by, for example, providing further partitions extending parallel to the end walls 13 and 14, respectively, in addition to the partitions 15. A grid formed of partitions is thereby attainable, each partition field being provided with an air-intake connection or union 17 so that it is possible to activate respective outlet openings 21 in a very fine screening or scanning grid.

The foregoing is a description corresponding in substance to German Application P 42 13 020.4, dated Apr. 21, 1992, the International priority of which is being claimed for the instant application, and which is hereby made part of this application. Any material discrepancies between the foregoing specification and the aforementioned corresponding German application are to be resolved in favor of the latter.

I claim:

1. A sheet delivery apparatus for a sheet-processing machine having a sheet-conveying device for successively conveying sheets to a device for receiving a sheet pile thereon, comprising a device disposed above a sheet-pile receiving device for generating an air flow to facilitate with air depositing of the sheets upon the pile-receiving device, said air-flow generating device having an air-supplied air-volume chamber having a basal surface and formed with outlet openings distributed over said basal surface thereof, said basal surface having an area corresponding approximately to a maximum sheet format; and covering means for sealing at least some of said outlet openings so as to adjust at least one of air-flow intensity and air diffusion of air escaping from said air-volume chamber.

2. The sheet delivery apparatus according to claim 1, wherein said air-volume chamber has a bottom wall defining said basal surface, said outlet openings being formed in said bottom wall.

3. The sheet delivery apparatus according to claim 2, wherein said bottom wall is a perforated plate.

4. The sheet delivery apparatus according to claim 2, wherein said bottom wall is a plate formed with a multiplicity of round holes therein.

5. The sheet delivery apparatus according to claim 2, wherein said bottom wall is formed, at least in part, of ferromagnetic material.

6. The sheet delivery apparatus according to claim 1, wherein said covering means are a magnetic covering.

7. The sheet delivery apparatus according to claim 6, wherein said magnetic covering comprises at least one of a magnetic plate and a magnetic foil.

8. The sheet delivery apparatus according to claim 1, wherein said covering means are formed of a plurality of individual covers.

9. The sheet delivery apparatus according to claim 1, wherein said air-volume chamber is formed with a plurality of sectional chambers.

10. The sheet delivery apparatus according to claim 9, including partitions disposed in said air-volume chamber and defining said sectional chambers.

11. The sheet delivery apparatus according to claim 9, including separate air-intake connections, respectively, communicating with each of said sectional chambers.

12. The sheet delivery apparatus according to claim 11, including an air-intake control device connected to said air-intake connections for supplying an individually determinable air flow therethrough to each of said sectional chambers.

* * * * *